US005326027A

United States Patent [19]

Sulfstede

[11] Patent Number: 5,326,027

[45] Date of Patent: Jul. 5, 1994

[54] AUTOMATIC CONFIGURATION OF AIR CONDITIONING CONTROLLER

[75] Inventor: Louis E. Sulfstede, Tyler, Tex.

[73] Assignee: American Standard Inc., New York, N.Y.

[21] Appl. No.: 790,031

[22] Filed: Nov. 12, 1991

[51] Int. Cl.[5] ..... B05D 23/00; F24F 11/02

[52] U.S. Cl. ..... 236/51; 165/11.1; 307/155; 236/94

[58] Field of Search ..... 236/81, 94; 307/155; 165/11.1

[56] References Cited

U.S. PATENT DOCUMENTS

| | | | |
|---|---|---|---|
| 4,028,688 | 6/1977 | Goleman | 340/227 |
| 4,174,517 | 11/1979 | Mandel | 340/310 A |
| 4,287,939 | 9/1981 | Pohl et al. | 236/51 |
| 4,323,787 | 4/1982 | Sato et al. | 307/155 |
| 4,336,902 | 6/1982 | Neal | 236/46 R |
| 4,433,719 | 2/1984 | Cherry et al. | 165/26 |
| 4,441,545 | 4/1984 | Alley et al. | 236/51 |
| 4,502,290 | 3/1985 | Suzuki et al. | 62/229 |
| 4,704,607 | 11/1987 | Teather et al. | 340/825.07 |
| 4,729,293 | 3/1988 | Tsunoda et al. | 98/40.24 |
| 4,734,871 | 3/1988 | Tsunoda et al. | 364/557 |
| 4,824,012 | 4/1989 | Tate | 236/49.5 |
| 4,860,950 | 8/1989 | Reeser et al. | 236/51 |
| 4,969,508 | 11/1990 | Tate et al. | 165/22 |

FOREIGN PATENT DOCUMENTS

| | | | |
|---|---|---|---|
| 0079087 | 5/1983 | European Pat. Off. | 236/51 |
| 0448087A1 | 3/1991 | European Pat. Off. . | |
| 0070631 | 6/1979 | Japan | 236/51 |
| 0116046 | 9/1980 | Japan | 236/51 |
| 0092637 | 6/1982 | Japan | 236/51 |
| 0175434 | 8/1986 | Japan | 236/51 |
| 0190235 | 8/1986 | Japan | 236/51 |
| 0190236 | 8/1986 | Japan | 236/51 |
| 0213546 | 9/1986 | Japan | 236/81 |
| 0019635 | 1/1987 | Japan | 236/51 |
| 0075437 | 4/1988 | Japan | 236/51 |
| 3-122442 | 5/1991 | Japan | 236/51 |
| 3-122443 | 5/1991 | Japan | 236/51 |

OTHER PUBLICATIONS

American Standard Inc., "Air Handling Mini Split", 1990 (brochure).

*Primary Examiner*—John K. Ford

*Attorney, Agent, or Firm*—William J. Beres; William O'Driscoll; Peter D. Ferguson

[57] ABSTRACT

A self configuring air conditioning system. The system includes a system controller for an air conditioning system operably connected to a compressor and an expansion valve, a first portable wireless remote controller for providing commands and information to the system controller by wireless transmission, and a second portable wired remote controller for providing commands and information to the system controller by wired transmission. The system further includes a wireless receiver operably connected to the system controller for receiving wireless remote transmissions from the first portable wireless remote controller, and an interface operably connected to the system controller for receiving wired remote transmissions from the second wired remote controller. The system also includes means, operatively associated with the system controller and responsive to the interface, for automatically establishing a first air conditioning system operating configuration if the wired remote controller is present, and for establishing a second air conditioning system operating configuration if the wired remote controller is absent.

14 Claims, 4 Drawing Sheets

FIG. 1
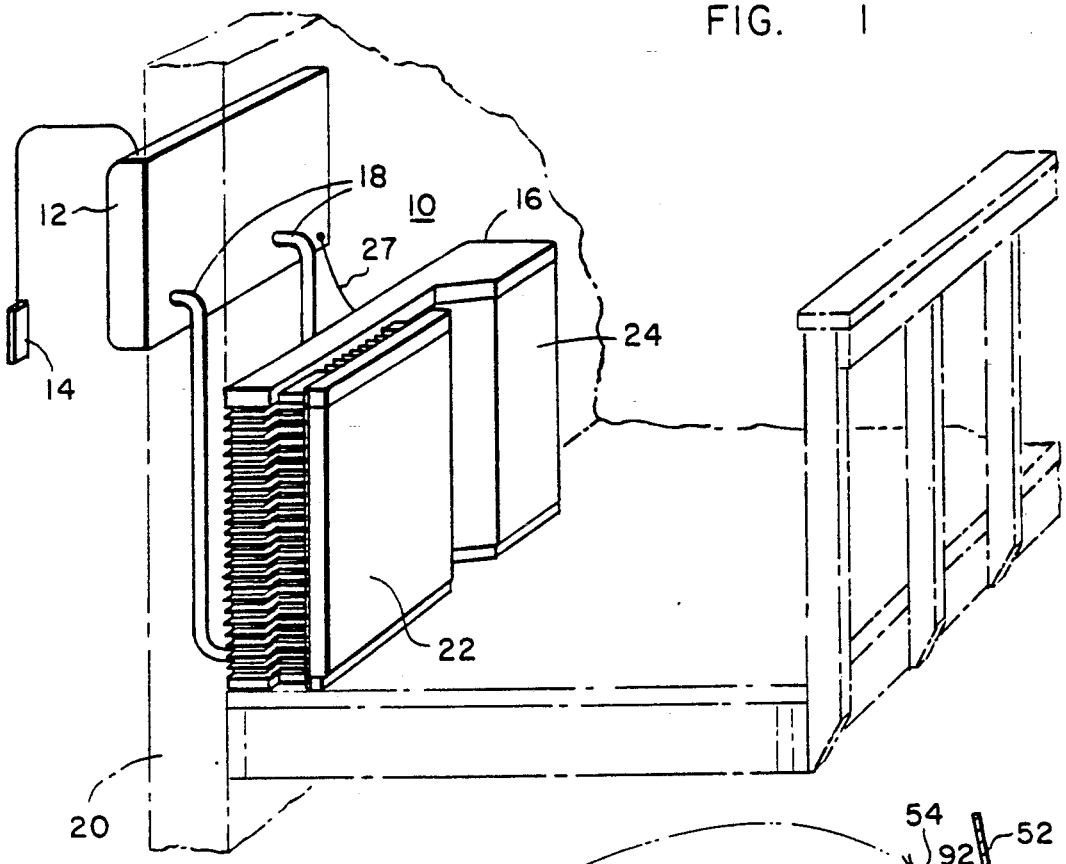
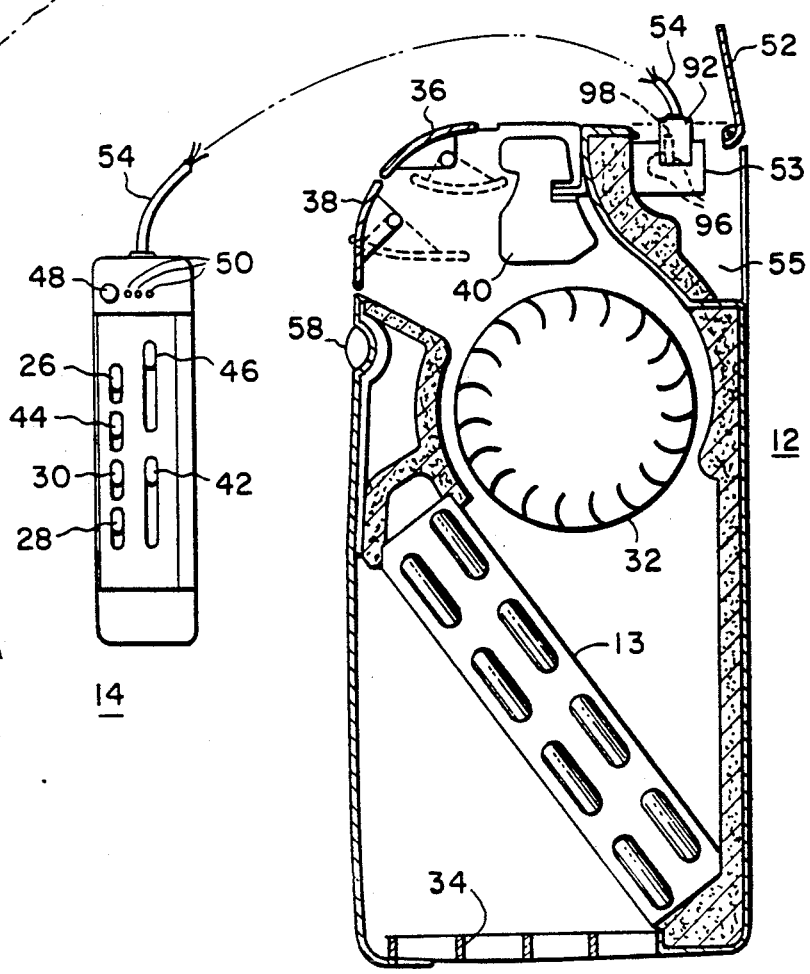
FIG. 2A

FIG. 4
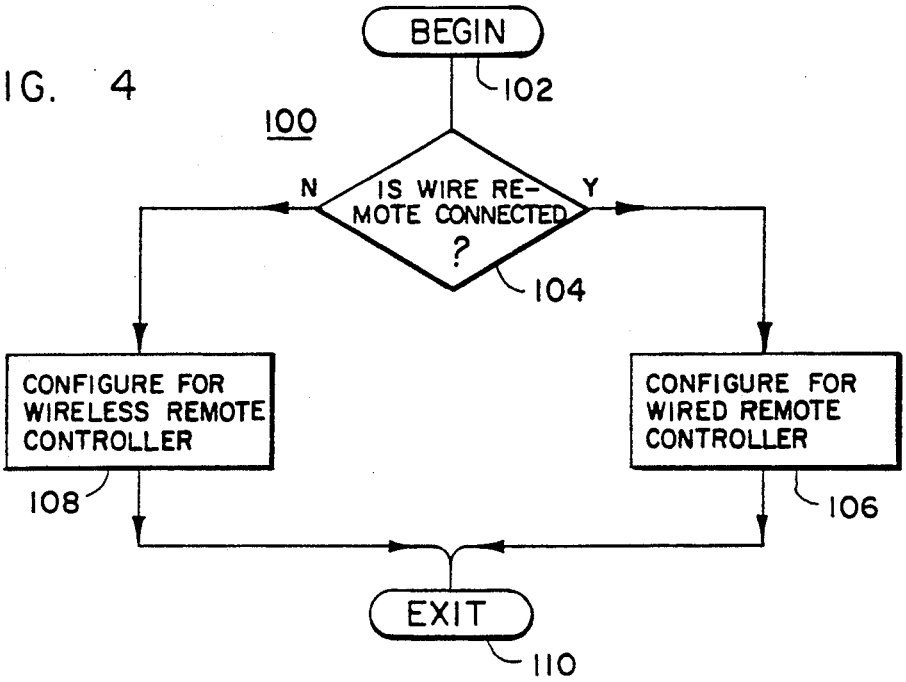
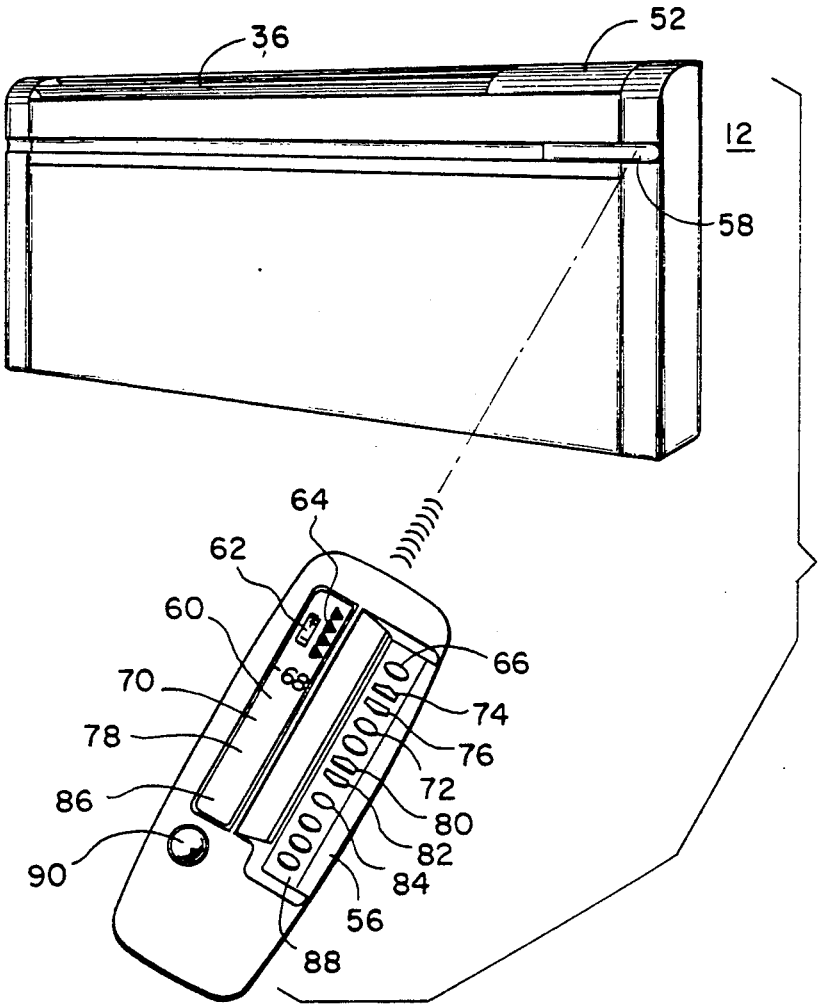
FIG. 3

AUTOMATIC CONFIGURATION OF AIR CONDITIONING CONTROLLER

BACKGROUND OF THE INVENTION

The present invention is directed to controllers for air conditioners, and more particularly, to a method and an apparatus for automatically configuring the system controller of an air conditioner for use with either a wired or a wireless remote controller.

The installation of remote and system controllers for air conditioners is a technical job requiring a skilled installer. The installer, by breaking jumpers, setting DIP switches or programming, instructs the air conditioning system controller as to the inclusion in the air conditioning system of a wired or wireless remote controller. Many customers would like to save the costs involved in hiring an installer, but lack the technical skills to make their own installation. In fact, some air conditioning systems must be configured at the factory.

Additionally, it is desirable to allow a consumer to automatically upgrade from a wired remote controller to a wireless remote controller without the necessity of a house call by an expert installer. Conversely, it is also desirable to allow a consumer to automatically downgrade from a wireless remote controller to a wired remote controller, should the wireless remote controller fail.

SUMMARY OF THE INVENTION

It is an object, feature and an advantage of the present invention to solve the problems of prior art air conditioning controllers.

It is an object, feature and an advantage of the present invention to allow an air conditioner to operate with either a wired or a wireless remote controller.

It is a further object, feature and an advantage of the present invention to automatically determine in the system controller of an air conditioner whether or not to operate using a wired or a wireless remote controller.

It is an object, feature and an advantage of the present invention to allow a consumer to install a wired or a wireless remote controller without the necessity of expert help.

It is an object, feature and an advantage of the present invention to remove the technical installation requirements so that a consumer may make his own installation of a wireless or wired remote controller.

It is an object, feature and an advantage of the present invention to provide automatic reconfiguration of an air conditioning system in response to a change in the type of remote controller.

It is an object, feature and an advantage of the present invention to allow easy and automatic upgrade from a wired remote controller to a wireless remote controller.

It is an object, feature and an advantage of the present invention to allow an easy and automatic downgrade from a wireless remote controller to a wired remote controller.

It is an object, feature and an advantage of the present invention to exclude the operation of non-enabled system operating configurations.

It is an object, feature and an advantage of the present invention to eliminate factory configuration of air conditioning systems.

It is an object, feature and an advantage of the present invention to delay system configuration until installation or later.

The present invention provides a self configuring air conditioning system. The system includes: an air conditioner including an outside heat exchange unit, an inside heat exchange unit, a first refrigerant conduit connecting the outside heat exchange unit to the inside unit and including an expansion device therein, and a second refrigerant conduit connecting the outside unit to the inside unit and including a compressor therein. The system also includes a system controller for the air conditioning unit operably connected to the compressor, a first portable remote controller for providing commands and information to the system controller by wireless transmission, and a second portable wired remote controller for providing commands and information to the system controller by wired transmission, the system further includes a wireless receiver, operably connected to the system controller, for receiving wireless remote transmissions from the first portable wireless remote controller, and an interface, operably connected to the system controller, for receiving wired remote transmissions from the second wired remote controller. The system also includes means, operatively associated with the system controller and responsive to the wired remote interface, for automatically establishing a first air conditioning system operating configuration if the wired remote controller is present, and for establishing a second air conditioning system operating configuration if the wired remote controller is absent.

The present invention also provides an air conditioning system which includes: a compressor; an outdoor heat exchanger; an indoor heat exchanger; an expansion device; and refrigeration conduit for serially connecting the compressor to the outdoor heat exchanger, the outdoor heat exchanger to the expansion device, the expansion device to the indoor heat exchanger, and the indoor heat exchanger to the compressor. The system further includes a system controller for controlling the operation of the compressor. The controller includes an infrared receiver and a wired remote receptacle. The controller also includes a sensor or an input for determining the presence of a connector in the wired remote receptacle, and means, responsive to the sensor or input, for inhibiting the operation of the infrared receiver if a connector has been determined to be in the receptacle.

The present invention further provides a method of configuring an air conditioner for remote control. The method comprises the steps of: determining if a portable wired remote controller is connected to the air conditioning system; automatically configuring the air conditioning system to operate using the portable wired remote controller if the portable wired remote controller is connected to the air conditioning system; automatically configuring the air conditioning system to operate with a wireless remote controller if the portable wired remote controller is not connected to the air conditioning system; and operating the air conditioning system in accordance with the established configuration.

BRIEF DESCRIPTION OF THE DRAWINGS

FIG. 1 shows a split system air conditioning unit.

FIG. 2(A) shows a cutaway view of the indoor section of the split system air conditioner of FIG. 1 including a wired remote controller.

FIG. 3 shows a perspective view of the indoor section of the split system air conditioning unit of FIG. 1 including a wireless remote controller.

FIG. 4 is a flow chart of the present invention.

DETAILED DESCRIPTION OF THE DRAWINGS

Figure 2B:
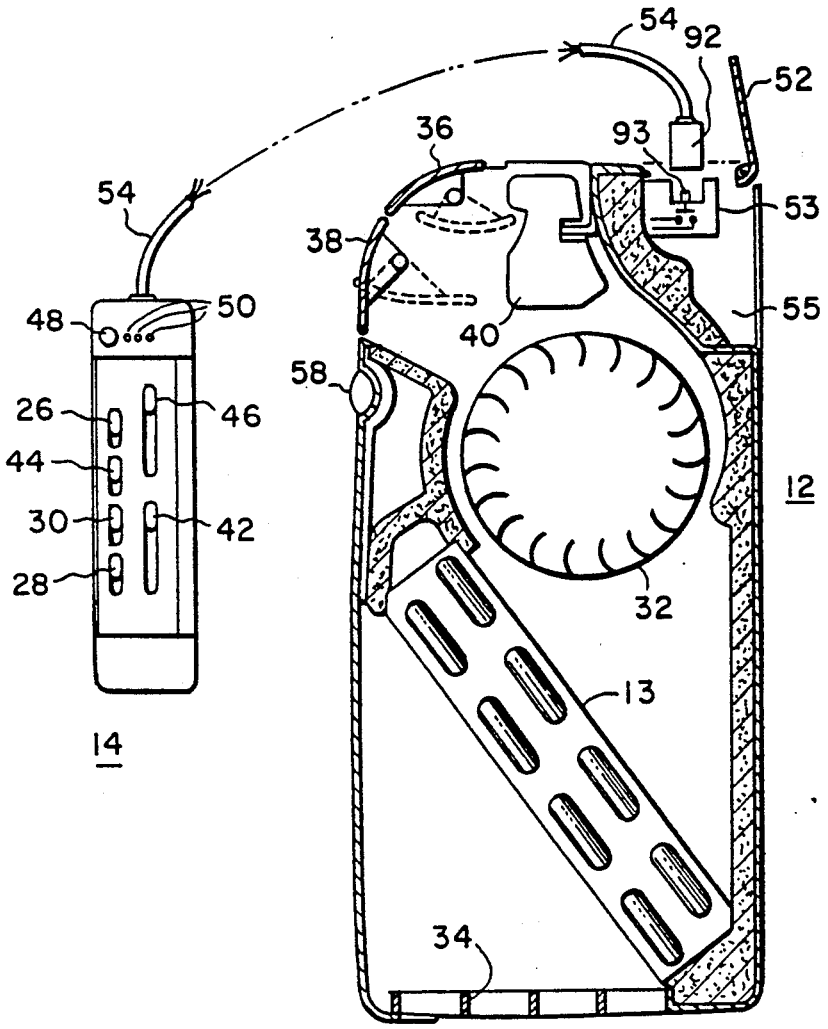
FIG. 2(B) is an alternate embodiment of the present invention as shown in FIG. 2(A).

FIG. 1 shows the general arrangement of a split system air conditioning unit 10 including an indoor section 12 having an inside heat exchange coil 13, and a wired remote controller 14 for controlling the operation of the split system unit 10. The split system unit 10 also includes an outside section 16 connected to the indoor section 12 by refrigerant conduit 18. The outside section 16 is suitable for mounting on an exterior wall 20. The outside section 16 conventionally includes an outside heat exchange coil and a refrigerant expansion device (not shown) in a first portion 22 and a compressor (not shown) in a second portion 24. Under the control of a system controller 25, preferably located within the indoor section 12, the split system unit 10 conventionally modulates the temperature of an interior space by controlling compressor and fan speeds and times of operation. The system controller 25 is linked to the outside section 16 by an electrical connecting line 27, and is described in connection with FIG. 5.

FIG. 2 shows the indoor unit 12 including the wired remote controller 14. The wired remote controller 14 allows a user to enter commands and provide information to the system controller 25. The wired remote controller 14 includes a switch 26 dperable to control the system mode of operation between heating, cooling, automatic, and off. The wired remote controller 14 also includes a switch 28 to control a fan mode of operation between automatic, continuous on, and off. The wired remote controller 14 includes a fan speed controller switch 30 operable to control the speed of a fan 32 within the inside unit 12. The fan 32 is operable to draw air across the inside heat exchange coil 13 from an inlet 34 and out an outlet 36. The location of the inlet 34 and the outlet 36 will vary depending on whether the indoor unit 12 is a floor standing unit or the wall mount unit shown in FIGS. 1 and 2. Various louvers 38, 40 are provided to direct the flow of air as it exits the outlet 36. The wired remote controller 14 also includes a temperature setpoint set switch 42 which establishes the temperature setpoint for the space being conditioned. A timer switch 44 is operable to turn a time function on or off. The duration of the timed function is set by an hour setpoint switch 46. A button 48 is provided to turn the air conditioning system 10 on and off and display the operational status of the system 10 in a display 50.

The system controller 25 is operably connected to the wired remote controller 14 by a cable 54. The system controller 25 uses the information and commands received from the wired remote controller 14 to control the operation of the air conditioning system 10. The cable 54 of the wired remote controller 14 is connected to a system controller interface 53 within the indoor unit 12. A pop-up section 52 may be provided to provide a storage space 55 within the indoor unit 12 for the wired remote controller 14 or a wireless remote controller 56.

FIG. 3 shows the indoor unit 12 with a wireless remote controller 56 instead of the wired remote controller 14. The wireless remote controller 56 sends out infrared signals which are received at the indoor unit 12 by a infrared signal sensor 58. The signals are then forwarded to the system controller 25 and processed in a manner similar to signals received from the wired remote controller 14.

The wireless remote controller 56 includes a liquid crystal display 60 which displays system parameters such as battery status 62, the system mode of operation 64 as controlled by a system mode button 66, and, optionally, sensed temperature 68 as sensed by a temperature sensor within the wireless remote controller 56. The liquid crystal display 60 also displays the fan speed 70 as controlled by a fan speed button 72, and displays the temperature setpoint as controlled by up and down buttons 74, 76 respectively. A further section 78 of the liquid crystal display 60 displays timed control as controlled by timer buttons 80, 82 and 84. The fan operating mode 86 is also displayed on the liquid crystal display 60 and controlled by a fan mode button 88. An on/off button 90 controls the overall operational status of the split system air conditioning unit 10.

The wired remote controller 14 includes a plug connector 92 at the end of the cable 54 which attaches to the system controller interface 53. The attachment of this plug connector 92 to the interface 53 is recognized by an indicator 94. The indicator 94 provides an indication to the system controller 25 of the split system air conditioning unit 10 that the wired remote controller 14 is physically connected to the inside unit 12. This indication 94 can be accomplished in a number of ways preferably by including two extra pins 96 in the connector 92 to provide a binary input, such as by a jumper 98 shown in FIG. 2, to the system controller 25 indicating that the controller is present. Alternatively, a low power electric circuit can be included which is closed by the presence of the connector 92. As shown in FIG. 2(B) another alternative includes a contact switch 93 which is depressed by the connection of the connector 92 to the inside unit 12. Many other methods of detecting this connection are possible and contemplated.

FIG. 4 shows a flow chart 100 of the present invention. At step 102, the system controller 25 of the split system air conditioning unit 10 enters this routine at initialization and regularly thereafter as part of its normal operating program. At step 104 the indicator 94 indicative of whether the connector 92 is present is checked. If a positive response is provided by the indicator 94, the wired remote controller 14 is considered to be connected and step 106 is followed. If step 106 is followed, the air conditioning system configuration is automatically set up for a wired remote controller 14 and any signals received by the infrared signal sensor 58 are treated as invalid and excluded from the system controller 25. On the other hand, if the indication 94 at step 104 is negative, then step 108 is followed and the configuration is made for a wireless remote controller 56. Infrared signals received on the infrared sensor 58 are treated as valid signals and forwarded to the system controller 25 while signals received by the plug connector 92 are treated as invalid and excluded from the system controller 25. Consequently, if the customer desires to upgrade or downgrade the system by adding a wireless remote controller 56, or temporarily or permanently installing a wired remote controller 14, the system controller 25 will automatically and, from the customers point of view, almost instantly respond by reconfiguring the air conditioning system 10.

Figure 5:
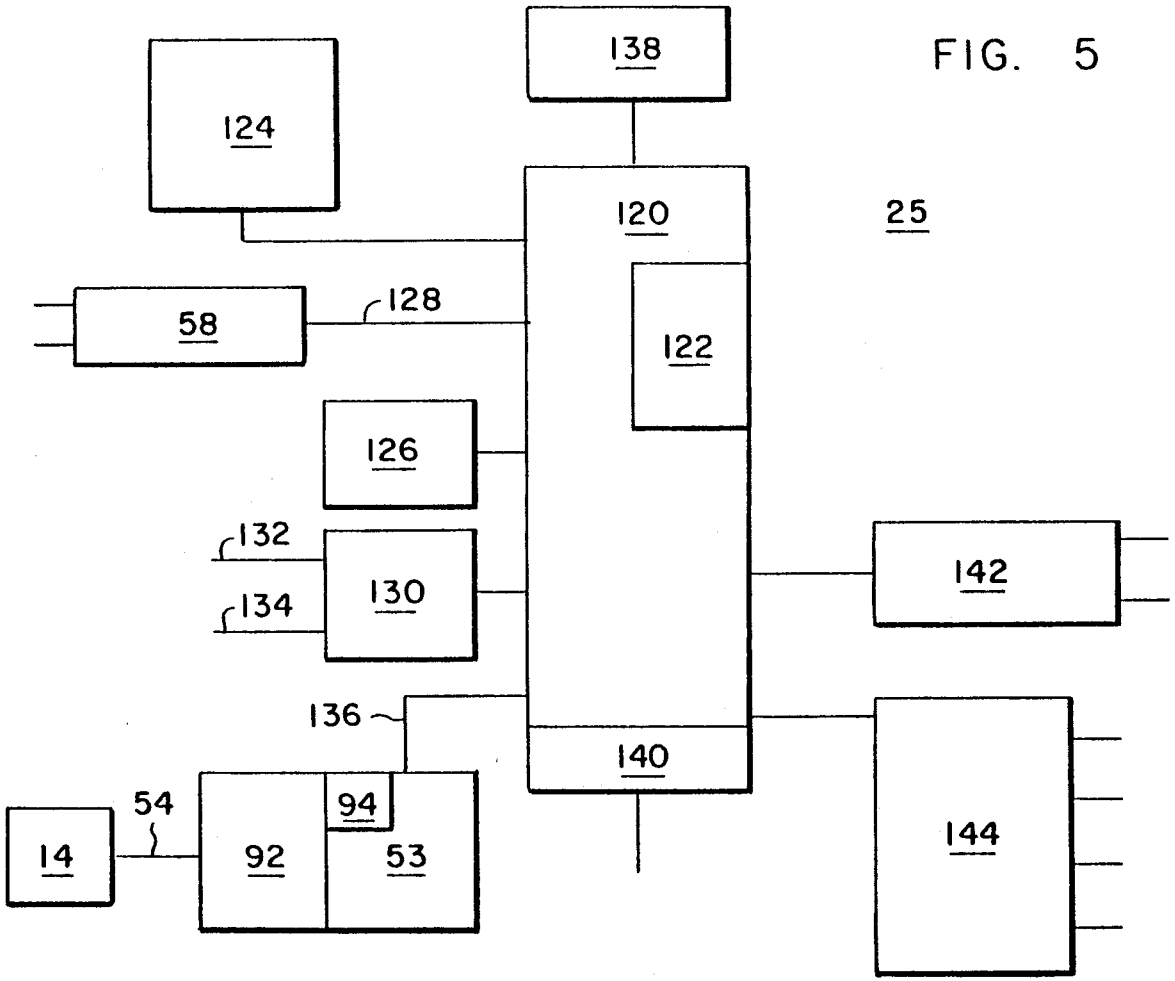
FIG. 5 shows a block diagram of the air conditioning system controller.

FIG. 5 shows a block diagram of the system controller 25. The system controller 25 includes a microprocessor 120 having a 32 kilohertz quartz clock 122. A power supply 124 supplies power to the microprocessor 120, and essential data and programs are stored on an EEPROM 126. Connection 128 connects the microcomputer 120 to the infrared receiver 58. The microcomputer 120 also includes an analog interface 130 which allows the receipt of such inputs as indoor temperature 132 or heat exchanger temperature 134. A connection 136 connects the system controller interface 53 and the indicator 94 to the microcomputer 120. The microcomputer may also be provided with an annunciator 138 to provide a visual display on the indoor unit 12 the user's benefit, and may be provide a serial communications interface 140 to a building automation system or a modem. The system controller 25 also includes an output 142 to control the fan and compressor of the outdoor unit 16 as well as an output 144 to control whatever heaters, fans and dampers are associated with the indoor unit 12. Although the system controller 25 is preferably located within the indoor unit 12, the system controller may also be located in the outdoor unit 16 if it is protected from the weather, or may be located in a third location distinct from either the indoor unit 12 or the outdoor unit 16 if desireable.

It should be recognized that the present invention is not intended to be limited to infrared signals provided by the wireless remote controller 14 and contemplates the use of ultrasonic, as well as radio frequency and spread spectrum radio frequency signals. Additionally, the cable 54 linking the wired remote controller 14 to the inside unit 12 is intended to encompass conventional variations of an electrical or fiber optic cable. Finally, the split system air conditioning system 10 described herein is not intended to be limited solely to split system air conditioning units but the present invention is intended to be applicable to all air conditioning systems specifically including heat pumps. Consequently it should be recognized that modifications and alterations of the present invention as described herein are possible and contemplated. All such modifications and alterations are intended to be in the spirit and scope of the present invention.

What is desired to be secured by Letters Patent of the United States is as follows.

I claim:

1. A method of configuring an air conditioner for remote control by either a wired receptacle or a wireless receiver comprising the steps of:

determining, independently of a control wire connection between the air conditioning system and a portable wired remote controller, if the portable wired remote controller is physically connected to the air conditioning system by means of the wired receptacle;

providing an indication that the portable wired remote controller is physically connected to the wired receptacle;

automatically configuring the air conditioning system to operate using the portable wired remote controller if the portable wire remote controller is physically connected to the air conditioning system;

automatically configuring the air conditioning system to operate with a wireless remote controller and the wireless receiver if the portable wired remote controller is not connected to the air conditioning system; and operating the air conditioning system in accordance with the established configuration.

2. The method of claim 1 including the further steps of periodically re-executing the determining step, and excluding the operation of the nonconfigured operation until the result of the determining step changes.

3. The method of claim 1 including the further step of providing a thermostat function in the wireless remote controller.

4. The method of claim 3 including displaying thermostat function parameters on a liquid crystal display on the wireless remote controller.

5. The method of claim 1 including the further step of displaying system status and commands on a liquid crystal display on the wireless remote controller.

6. The method of claim 1 including the further step of automatically upgrading from a wired remote controller to a wireless remote controller.

7. The method of claim 1 including the further step of automatically downgrading from a wireless remote controller to a wired remote controller.

8. The method of claim 1 including the further step of transmitting commands and information from the wireless remote controller to the air conditioning system using infrared media, ultrasonic media, radio frequency media, or spread spectrum radio frequency media.

9. An air conditioning system comprising:

an outdoor heat exchanger;

an indoor heat exchanger;

refrigeration conduit for serially connecting the outdoor heat exchanger to the indoor heat exchanger, and the indoor heat exchanger to the outdoor heat exchanger;

means for controlling the operation of the outdoor heat exchanger, the control means including an infrared receiver and a wired remote receptacle operably connected to the control means by a control wire connection;

wherein the control means includes means, independent of the control wire connection, for determining the presence of a connector in the wired remote receptacle; means, responsive to the determining means, for inhibiting the operation of the infrared receiver if a connector has been determined to be in the receptacle; means, responsive to the determining means, for inhibiting the operation of the wired remote receptacle if a connector is not in the receptacle; means, responsive to the determining means, for enabling the operation of the infrared receiver if a connector is not in the receptacle; and means, responsive to the determining means, for enabling the operation of the wired remote receptacle if a connector has been determined to be in the receptacle;

wherein the determining means includes a contact switch in the wired remote receptacle.

10. A self configuring air conditioning system comprising:

an air conditioner including an outside heat exchange unit, an inside heat exchange unit, first refrigerant conduit connecting the outside heat exchange unit to the inside unit, second refrigerant conduit connecting the outside unit to the inside unit;

a system controller for the air conditioning unit operably connected to the outside heat exchange unit;

a first portable wireless remote controller for providing commands and information to the system controller by wireless transmission;

a second portable wired remote controller interconnected to the system controller by a control wire connection and providing commands and information to the system controller by wired transmissions on said control wire connection;

means, operably connected to the system controller, for receiving wireless remote transmissions from the first portable wireless remote controller;

means, operably connected to the system controller, for receiving wired remote transmissions from the second wired remote controller, the wired remote receiving means including means, independent of the control wire connection, for providing an indication that the second wired remote controller is physically connected to the system controller;

means, operatively associated with system controller and responsive to the wired remote receiving means, for automatically establishing a first air conditioning system operating configuration if the wired remote controller is physically connected to the system controller and for establishing a second air conditioning system operating configuration if the wired remote controller is absent; and means responsive to the automatic establishing means, for disabling all non-established air conditioning operating system configurations.

11. The system of claim 1 wherein the first portable wireless remote controller provides a thermostat function.

12. The system of claim 1 wherein the inside heat exchanger is within a housing which includes storage within the housing for either the first or second remote controller.

13. The system of claim 1 wherein the first portable wireless remote controller includes a liquid crystal display.

14. An air conditioning system comprising:

an outdoor heat exchanger;

an indoor heat exchanger;

refrigeration conduit for serially connecting the outdoor heat exchanger to the indoor heat exchanger, and the indoor heat exchanger to the outdoor heat exchanger;

means for controlling the operation of the outdoor heat exchanger, the control means including an infrared receiver and a wired remote receptacle;

wherein the control means includes; means for determining the presence of a connector in the wired remote receptacle; means, responsive to the determining means, for inhibiting the operation of the infrared receiver if a connector has been determined to be in the receptacle; means, responsive to the determining means, for inhibiting the operation of the wired remote receptacle if a connector is not in the receptacle; means, responsive to the determining means, for enabling the operation of the infrared receiver if a connector is not in the receptacle; and means, responsive to the determining means, for enabling the operation of the wired remote receptacle if a connector has been determined to be in the receptacle;

wherein the determining means detects the presence or absence of a jumper within a plug attached to the wired remote receptacle.

* * * * *

UNITED STATES PATENT AND TRADEMARK OFFICE

CERTIFICATE OF CORRECTION

PATENT NO. : 5,326,027

DATED : July 5, 1994

INVENTOR(S) : Louis E. Sulfstede

It is certified that error appears in the above-indentified patent and that said Letters Patent is hereby corrected as shown below:

Column 2, Line 14, after the word "portable" insert --wireless--.

In The Claims:

Claim 11, Column 7, Line 29, "claim 1" should read -- claim 10 --.

Claim 12, Column 7, Line 32, "claim 1" should read -- claim 10 --.

Claim 13, Column 7, Line 3, "claim 1" should read -- claim 10 --.

Signed and Sealed this

Sixth Day of September, 1994

Bruce Lehman

*Attest:*

BRUCE LEHMAN

*Attesting Officer*

*Commissioner of Patents and Trademarks*